United States Patent [19]

Batjer et al.

[11] Patent Number: 4,641,674

[45] Date of Patent: Feb. 10, 1987

[54] WASHER FOR DISPOSABLE CUVETTE ROTORS

[75] Inventors: John D. Batjer; Lindsay R. Eades, both of Bellevue; Raymond J. Liedtke; Arthur M. Zebelman, both of Seattle, all of Wash.

[73] Assignee: LabAdapt, Inc., Seattle, Wash.

[21] Appl. No.: 574,988

[22] Filed: Jan. 30, 1984

[51] Int. Cl.[4] ..... B08B 9/02

[52] U.S. Cl. ..... 134/138; 134/171; 422/63; 422/99; 422/100

[58] Field of Search ..... 134/56 R, 86, 92, 138, 134/141, 149, 152, 153, 158, 166 R, 171, 198, DIG. 1, 137, 157, 139, 201, 140, 169 R, 142, 170, 147, 199; 436/49; 494/16, 17; 422/102, 72, 63, 99, 100; 356/246

[56] References Cited

U.S. PATENT DOCUMENTS

| | | | |
|---|---|---|---|
| 1,695,212 | 12/1928 | Seitz | 134/152 X |
| 1,959,661 | 5/1934 | Ellington et al. | 134/138 X |
| 2,567,820 | 9/1951 | Messerschmidt | 134/138 |
| 3,047,000 | 7/1962 | Stingelin | 134/153 X |
| 3,235,173 | 2/1966 | Unger | 494/17 X |
| 4,127,137 | 11/1978 | Butcher | 134/198 X |
| 4,305,759 | 12/1981 | Westhoff et al. | 134/166 R X |
| 4,444,213 | 4/1984 | Taylor | 134/56 D |

FOREIGN PATENT DOCUMENTS

| | | | |
|---|---|---|---|
| 907057 | 10/1962 | United Kingdom | 134/138 |

OTHER PUBLICATIONS

Wu, A. H. B. et al., *Clinical Chemistry*, vol. 28, 2188–2189, 1982.

Wu, A. H. B. et al., *Clinical Chemistry*, vol. 29, 991, 1983.

"Eric Klaus" drawings, three sheets.

*Primary Examiner*—Philip R. Coe

*Assistant Examiner*—Frankie L. Stinson

*Attorney, Agent, or Firm*—Christensen, O'Connor, Johnson & Kindness

[57] ABSTRACT

A washer for cleaning a disposable cuvette rotor, which has a plurality of anaylsis cuvettes interconnected to form a ring. A stator, on which the ring is positioned for rotation, includes jets that direct flows of cleaning fluid in both horizontal and vertical directions into each of the chambers of the individual cuvettes. The jets are oriented so that turbulent flows of fluid clean the interior walls of each of the various chambers in the cuvettes. As well, the jets that direct the horizontal flow are oriented so as to drive the cuvette rotor rapidly in a circular motion about the stator. A regulator controls both the duration and pressure of the cleaning fluid provided to the jets while a fluid-tight container assures safe and efficient collection of the used cleaning fluid. In an alternate version of the washer, drainage of the spent wash fluid from the cuvettes is enhanced by slightly raising the cuvettes from the stator during a portion, or all, of their rotational travel.

12 Claims, 10 Drawing Figures

Fig. 2.
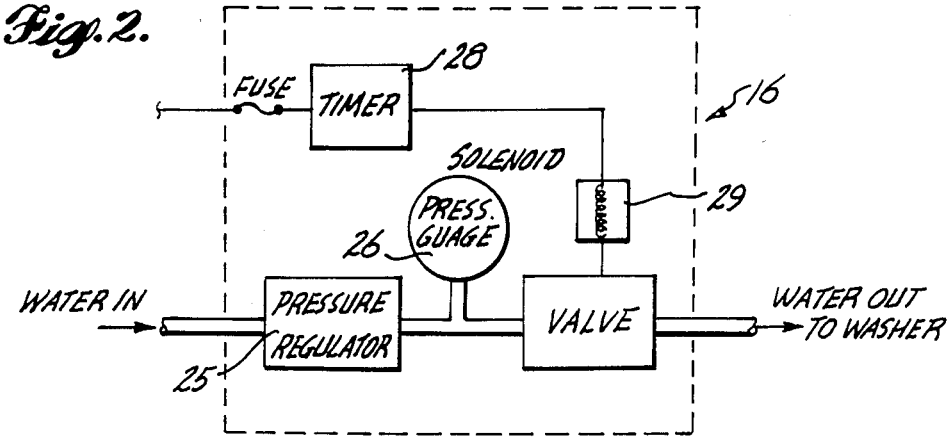
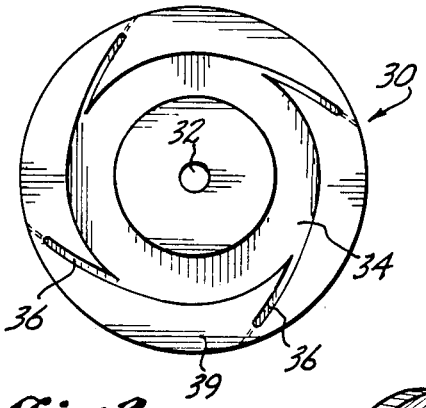
Fig. 3.
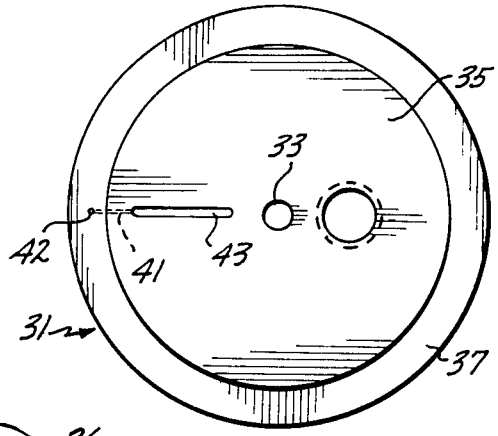
Fig. 4.
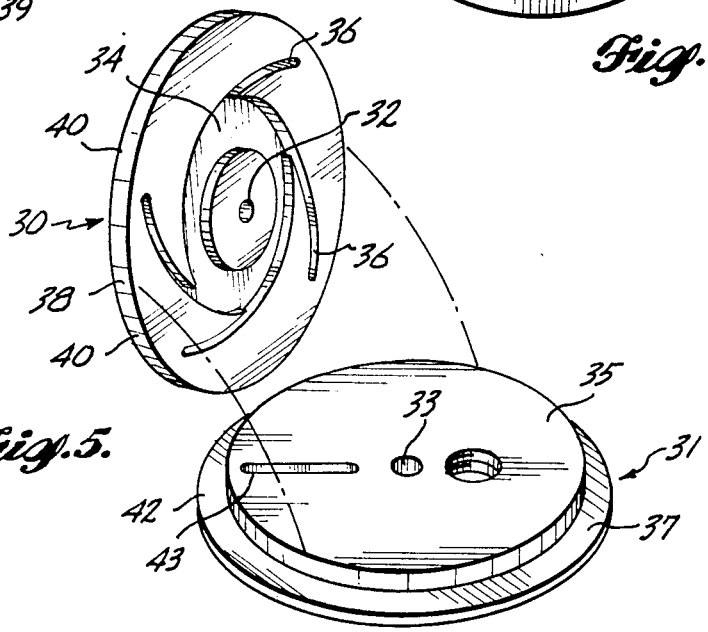
Fig. 5.

Fig. 6.
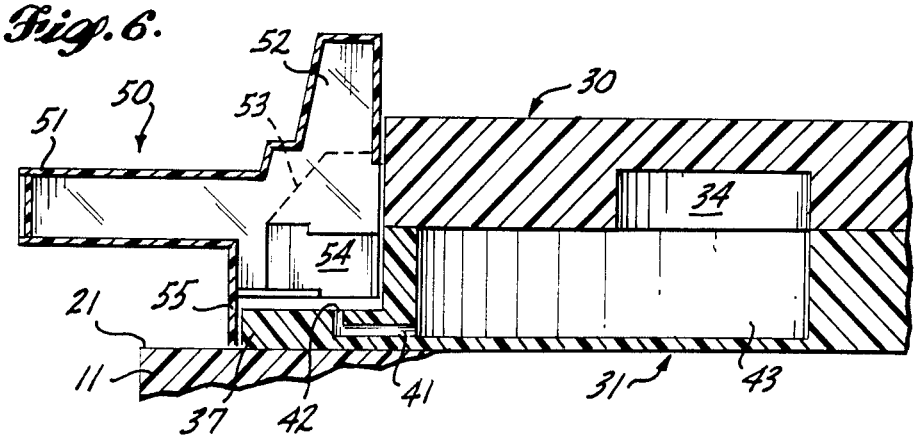
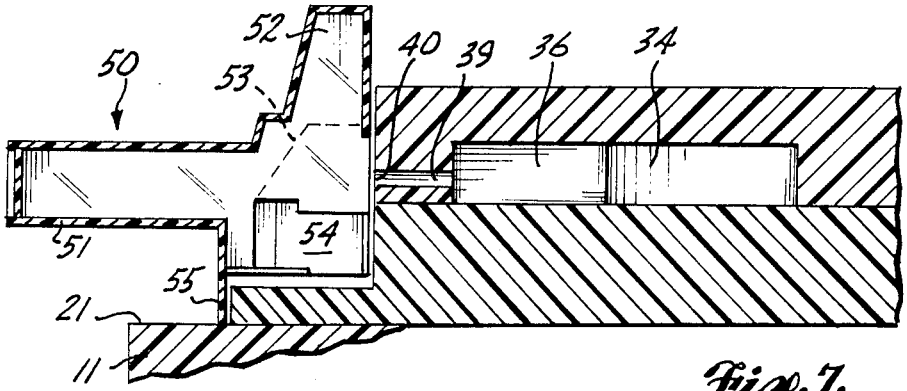
Fig. 7.
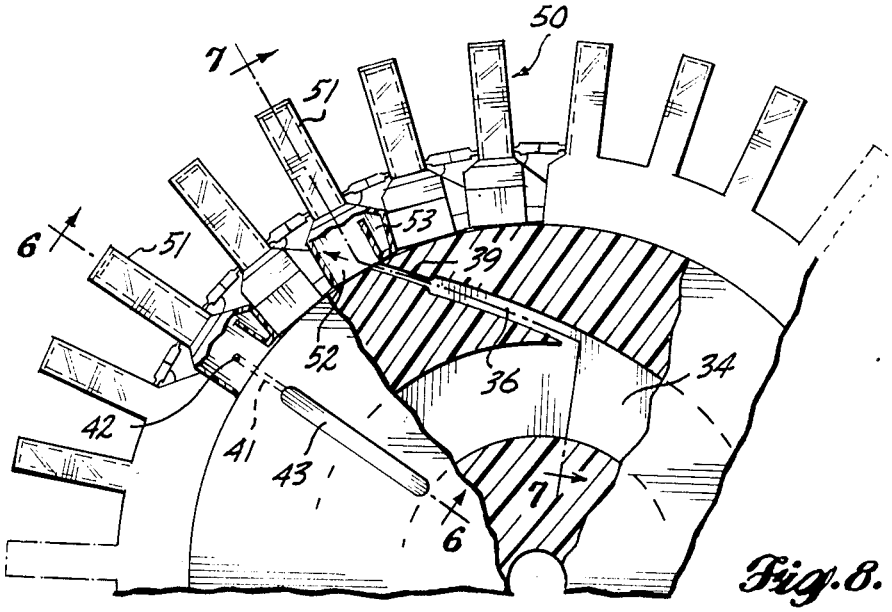
Fig. 8.

Fig. 9.
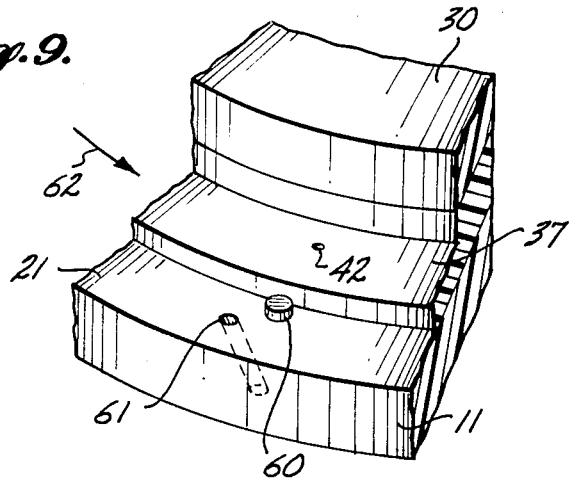
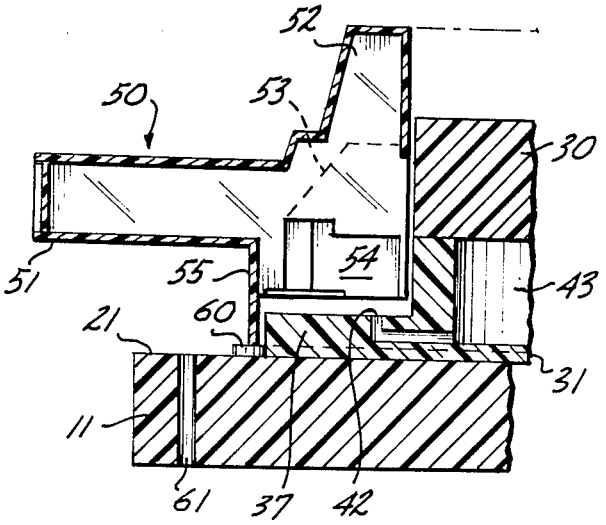
Fig. 10.

WASHER FOR DISPOSABLE CUVETTE ROTORS

BACKGROUND OF THE INVENTION

The present invention relates generally to centrifugal analyzers for clinical laboratories, and, more particularly, to a washer for cleaning, and thus rendering reusable, disposable plastic cuvette rotors.

A number of fully automated centrifugal analyzers are currently used to perform various clinical tests using spectrophotometric techniques. All of the analyzers employ a so-called cuvette rotor that consists of individual analysis cuvettes connected together to form a ring. Multiple tests are simultaneously conducted by introducing different mixtures of samples and reagents into the individual cuvettes. During operation, the rotor is spun rapidly, thus forcing the reaction mixtures of samples and reagents into the outermost ends of the cuvettes, where they are optically analyzed.

Centrifugal analyzers that employ disposable plastic rotors have been particularly well received. A major advantage of rotor disposability is the absolute assurance that there will be no carryover between tests, i.e., within a given cuvette, there will be no contamination of a subsequent test by the specimens, reagents, and reaction mixtures of an earlier test. In return for this guarantee against between-run cross-contamination, disposability of the rotor increases the per test cost of consumables. It has heretofore been recognized that the added expense of disposability could be reduced if the rotors could be made reusable through washing and drying.

One proposal for a washer is discussed by Wu, A. H. B.; Ohneck, J. Klaus; E. McComb, R. B., in *Clincal Chemistry,* Vol. 28, 2188–89 (1982) and by Wu, A. H. B. and McComb, R. B. at *Clinical Chemistry,* Vol. 29.991 (1983). The described washer was specifically designed for cleansing the disposable cuvette rotors used in the Cobas-Bio centrifugal analyzer offered by Roche Analytical Instruments, Inc., of Nutley, N.J. 07110. The cuvette rotor employed in the Cobas-Bio centrifugal analyzer contains 30 identical cuvettes that are joined together in a ring. The innermost portion of each cuvette contains two well-like cavities or chambers, a large one for receiving the reagents and a smaller one for receiving the samples. These cavities are positioned side by side with their open ends facing upward and oriented about vertical axes that are arranged parallel to the axis of rotation of the ring. A reaction chamber having an inwardly facing open end extends outward along a horizontal axis that is oriented at right angles to the axes of the sample and reagent cavities. The axis of each reaction chamber is also oriented radially relative to the axis of rotation of the ring so that, upon acceleration of the ring, the samples and reagents are spun upwards and out of the sample and reagent cavities and into the outermost ends of the reaction chambers where they are contained for analysis. The washer described by Wu et al. consists essentially of two discs, having identical external dimensions, which are joined face to face and rigidly mounted in the center of a table-like base that is essentially a square platform having legs at each corner. An annular supply channel milled into the lower surface of the upper disc mates with the upper surface of the lower disc and is connected by generally straight channels with four jets provided at equidistant points about the circular periphery of the upper disc. In operation, the cuvette rotor is placed in an inverted position, in a resting position on the platform and over the hub formed by the interconnected upper and lower discs. In this inverted position, the reaction/sample chambers face downward. Water is introduced by way of an inlet provided in the bottom of the table, then travels through the supply channel in the upper disc and horizontally outward through the jets. Since the jets are angled relative to the horizontal reaction chambers of the cuvettes, the water flowing from the jets enters these horizontal chambers at an angle and, hence, provides a force that spins the rotor. As the individual cuvettes pass each jet, the reaction mixture of sample and reagents is rinsed.

The above-described washer has been shown to be effective for removing the residual results of enzymatic tests. The washer has not, however, proven effective in the removal of the residual results of endpoint tests. Thus, for such endpoint tests, there is unacceptable reagent carryover to subsequent tests. Accordingly, rotors that have been used in one endpoint test may not be reused in conjunction with other endpoint tests.

Since no special provision is made for catching and draining fluid from this washer, the used washwater cascades freely over the edges of the platform after cleansing the rotor. Accordingly, the washer must be located in a sink for operation. This requirement not only monopolizes what may be one of a limited number of available sinks, but also may require locating the washer at a distance from the analyzer, which is unacceptable, both in terms of inconvenience and the increased likelihood of spills. As well, the uncontained, vigorous flow of contaminated washwater presents the likelihood that the operator will be exposed to harmful aerosols.

The foregoing washer ahso disadvantageously uses a significant quantity of water during the normal wash cycle. For example, about 32 litres of water is needed for a five-minute wash. Where deionized water is used as the cleansing fluid, such consumption is particularly costly.

The present invention provides an improved washer that overcomes the disadvantages of the developments described above. In particular, an important aspect of the invention is the provision of an arrangement of cleaning jets that assures good turbulence of the washing fluid within the cuvette chambers while, at the same time, providing rapid rotation of the ring. In accordance with a further aspect of the invention, a regulator controls both the pressure and duration of the flow to the jets and, thus, facilitates the development of, and adherence to, operating products, while also minimizing the amount of fluid consumed during a wash cycle.

SUMMARY OF THE INVENTION

In accordance with the invention, there is provided a washer for cleaning a disposable cuvette rotor having a plurality of cuvettes interconnected to form a ring. A stator, upon which the ring is positioned, includes jets for directing flows of fluid into the cuvettes in at least two predetermined directions in order to clean the cuvettes and rotate the ring. Supply means are provided for delivering a suitable cleansing fluid to the jets.

In a preferred form, the stator comprises an upper disc mounted to a base. A plurality of jets is disposed about the circular side periphery of the upper disc. Each of these jets is arranged to direct a flow of fluid into the cuvettes in a predetermined direction to spin the rotor and cleanse each cuvette as it rotates past the jet. To provide full cleansing of the cuvettes, the base also includes a jet that directs a flow of fluid into the cuvettes in a direction that is oriented at an angle relative to the directions of the flow from the jets of the upper disc.

In accordance with another aspect of the invention, the base includes a race for further guiding the cuvette ring during its rotation about the stator. In preferred form, the race is an annular ledge that encircles the lower periphery of the upper disc. In this arrangement, the additional base jet is disposed upon the annular ledge. Holes or slots cut through the race provide for drainage of wash fluid which improve the efficiency and the wash.

In accordance with additional aspects of the invention, the stator is preferably supported and enclosed within a container to collect the spent wash fluid and protect the operator against exposure to harmful aerosols. Advantageously, since the container enables use of the washer without a separate sink, only a small drain is required. Thus, the washer may be located at any convenient place within the laboratory as, for example, in close proximity to the centrifugal analyzer in conjunction with which it is used. To minimize the use of washwater and to assure consistent and thorough cleansing, it is preferred that the washer include a regulator for controlling the pressure and duration of the flow through the washer.

In accordance with yet another aspect of the invention, the cuvettes are lifted slightly from the base during a portion or all of their circular path of travel about the stator. This advantageously promotes drainage of the spent fluid from the cuvettes, which, in turn, permits introduction of a greater amount of cleansing fluid during a wash cycle.

BRIEF DESCRIPTION OF THE DRAWINGS

The invention can be understood by the following portion of the specification taken in conjunction with the accompanying drawings in which:

FIG. 2 is a simplified schematic diagram of a preferred regulator;

FIG. 3 is a bottom view of the top segment of a preferred form of the stator;

FIG. 4 is a top plan view of the lower segment of a preferred form of the stator;

FIG. 5 is an exploded perspective view showing the manner in which the stator is assembled from the upper segment of FIG. 3 and the lower segment of FIG. 4;

FIG. 6 is a partial sectional view through a cuvette and the stator along line 6—6 of FIG. 8;

FIG. 7 is a partial sectional view through a cuvette and the stator along line 7—7 of FIG. 8;

FIG. 8 is a plan view with parts broken of a portion of the stator with the cuvette rotor illustrated in simplified partial section;

FIG. 9 is a perspective view, with parts broken of a modified version of the washer; and, FIG. 10 is a partial sectional view of the modified version of the washer shown in FIG. 9, illustrating a cuvette lifted from the shelf.

DETAILED DESCRIPTION OF THE INVENTION

Figure 1:
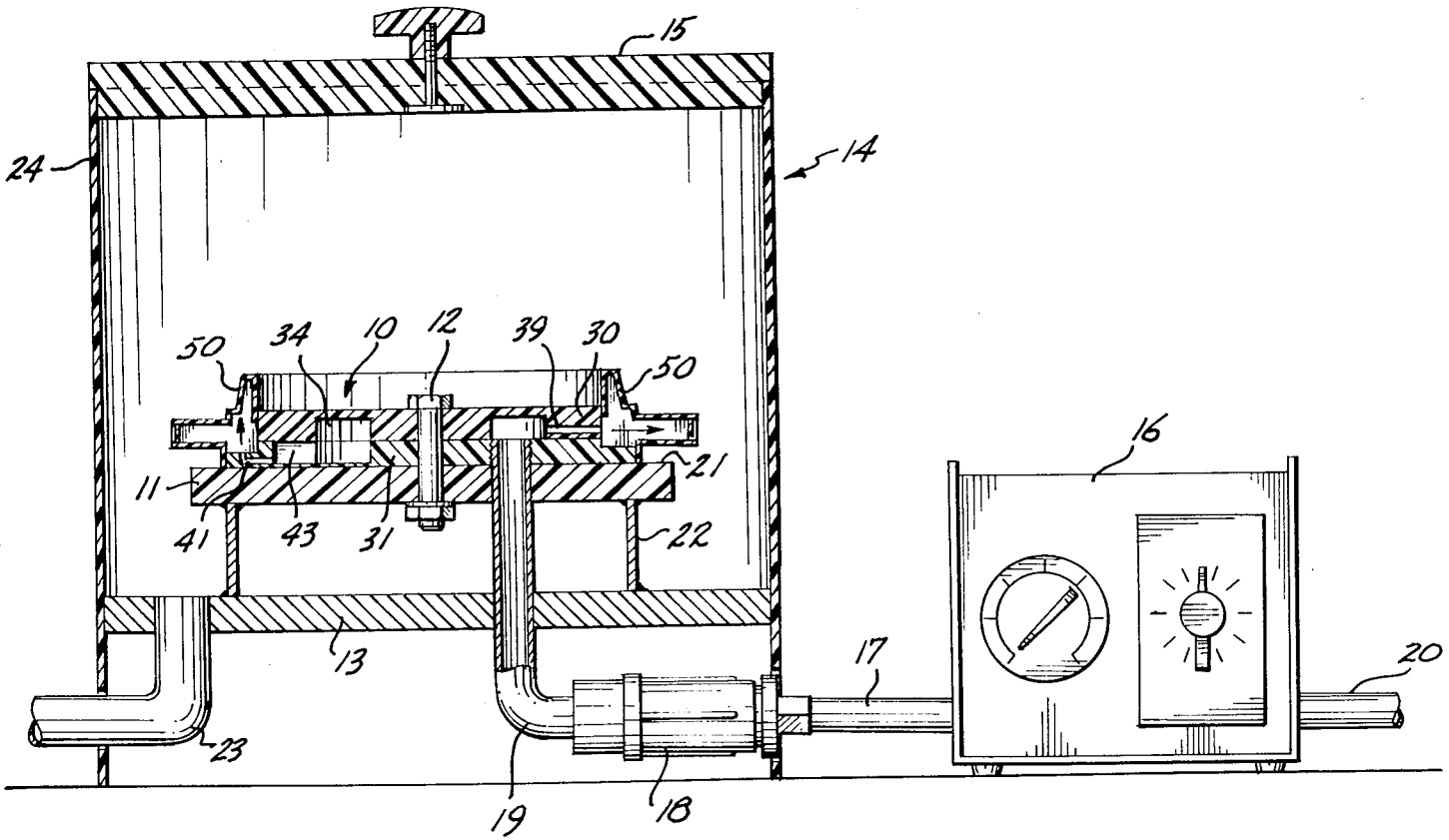
FIG. 1 is a front elevation view in partial cross section showing a washer according to the invention with a cuvette rotor in position for cleaning.

Referring first to FIG. 1, the washer includes a stator, generally designated 10, which is connected in fixed relation to a shelf 11 by means of a centrally located bolt 12. The shelf 11 is rigidly connected to a pedestal 22, which, in turn, is secured to the floor 13 of a containment vessel 14. The containment vessel is provided with a tight-fitting, removable lid 15.

A regulator 16 receives a flow of cleaning fluid through an inlet tube 20 from a source not shown in FIG. 1 and adjusts the pressure thereof to a predetermined level. The regulator then delivers a pressure-regulated flow through the transfer tubing 17, coupling 18, and inlet pipe 19 to a distribution and jet system contained within the interior of the stator 10. As will be discussed in greater detail hereinafter, the regulator 16 also includes a timer and valve arrangement that permits control of the duration of the pressure-regulated flow. The details of the distribution and jet system will also be described fully hereinafter. At this introductory juncture, it is to be noted that this system functions to direct flows of fluid in both horizontal and vertical directions into each of the individual cuvettes 50, which are interconnected in side-by-side relation to form the cuvette rotor, or ring. As illustrated in FIG. 1, the ring is positioned about the stator 10 and resting upon the upper surface 21 of the shelf 11. The individual jets are oriented so that turbulent flows of fluid thoroughly clean the interior walls of each of the various chambers in the cuvettes. As well, the jets that direct the horizontal flow are oriented so as to drive the cuvette rotor rapidly in a circular motion about the stator 10. In the illustrated arrangement, the stator provides a circular axle having a diameter that corresponds closely with the inside diameter of the cuvette rotor. This diameter is the distance between the inner faces of the two cuvettes 50 illustrated in FIG. 1. With this arrangement, the axis of rotation of the cuvette rotor lies generally coincident with the central longitudinal axis of the bolt 12. With this arrangement, it is also preferred, but not essential, that the shelf 11, pedestal 22, and container 14 have cylindrical shapes. In this form, the shelf 11, the floor 13 of the container, and the two sections of the lid 15 are solid discs, while the pedestal 22 and the side portion 24 of the containment vessel 14 are essentially hollow cylinders.

The cleansing fluid employed with the washer is selected in accordance with the types of samples and reagents used in the cuvettes, with regard also to the composition of the disposable plastic rotors. For the substances used in clinical testing, water has been found to provide good cleansing. It is necessary to use deionized water for at least the final portion of the wash because of ionic contaminants in tap water which may interface with subsequent assays. This final rinse may be performed as a separate operation, independent of the present washer if desired. Alternately, the washer may be connected to a source of deionized water for a short final rinse (for example, for about one minute). It will be appreciated that a suitable valve arrangment can be provided upstream of the regulator, to provide selective connection at the appropriate time to either a tapwater source or a deionized water source. Of course, the entire cycle may be carried out with deionized water.

The containment vessel 14 functions both to catch and drain the spent wash fluid through outlet pipe 23 and to prevent the escape of potentially harmful aerosols that are generated by the vigorous washing action and rapidly spinning rotor. To provide this containment, the components of the vessel 14, the coupling 18, and the inlet and outlet pipes 19 and 23, respectively, have fluid-tight connections. As well, the lid 15 fits tightly against the inner walls of the side of the vessel to provide a substantially fluid-tight seal.

To prevent interference with the rotary motion of the cuvette ring, the sizing of the outlet pipe 23 is selected in relation to the predetermined volume of the controlled flow from the regulator 16 so that the level of the collected fluid does not rise above the shelf 21.

Since the cleaning fluid is introduced, used, and drained within the closed system, it will be appreciated that, through the use of sufficient lengths of inlet and outlet tubing to and from the containment vessel and regulator, the washer may be conveniently located near the desired work area, for example, close to the centrifugal analyzer that will use the washed rotors. Unlike the prior washers that must be placed within a sink during operation, the present washer need only have access to a small drain outlet and water source. Typically, such other drains and water sources are more widely available in a laboratory than the usually limited number of sinks. Thus, these sinks remain available for other laboratory uses.

FIGS. 3, 4, and 5 illustrate in greater detail the preferred stator for the washer. Referring first to FIG. 5, the upper segment 30 is shown exploded through an angle upward and away from the lower segment 31. As can be seen in FIG. 1, these two segments are operatively assembled together and rigidly secured to the shelf 11 by bolt 12 that passes through centrally located bores 32 and 33 provided in the upper and lower segments, 30 and 31, respectively. The lower segment 31 has an upper disc portion 35 that is encircled at its lower end by an annular ledge 37. It is preferred that the lower segment 31 have a single-piece construction, which, for example, may be provided by milling the upper portion of a single disc to form the annular ledge 37 and upper disc portion 35. Alternately, the lower segment could be formed by joining two concentric discs. The upper segment 30 is also disc-shaped, having a diameter that corresponds with the diameter of the upper disc portion 35 of the lower segment. The diameters of these two components, in turn, correspond to the inner diameter of the cuvette rotor, as shown in FIG. 1. Since the interconnected upper segment 30 and upper disc portion 35 of the lower segment provide an axle about which the cuvette ring is rotated, it will be appreciated that the diameters of these two components are selected to provide a tolerance that permits rapid spinning of the ring without wobble. As seen best in FIGS. 6 and 7, the outermost edge of the annular ledge 37 lies closely adjacent the vertical extension 55 of the cuvettes. With this association, the annular ledge forms a race which further guides and stabilizes the rotor in its circular movement about the stator.

A water distribution and jet system is provided within the interior of the upper and lower segments of the stator to supply and direct the flow of washwater that cleans the individual cuvettes and propels the rotor. As shown in FIGS. 3 and 5, the upper segment 30 has an annular chamber 34 formed in its lower surface in generally concentric arrangement with the center of the disc. Four arcuate channels 36 extend tangentially outward from the outermost edge of the annular chamber. As illustrated, these arcuate channels have essentially the same depth as the annular chamber 34 and terminate at points spaced inward from the circular side periphery 38 of the upper segment 30. As shown in greater detail in the enlarged sectional view of FIG. 7, outlet channels 39 of substantially reduced diameter extend outward from the arcuate channels 36 to openings, or jets, 40 on the side periphery 38 of the upper segment. It has been found that the preferred arcuate channels 36 provide better spin and washing action than the known arrangement of straight channels. While it would be more ideal to form the outlet channels 39 so as to continue the curvature of the arcuate channels 36, such construction is more difficult to obtain. Accordingly, continuation of the desired curvature is approximated by drilling the outlet channels 39 inward from the side periphery 38, i.e., starting at the openings 40. With this construction, it is preferred that the outlet channels open into the cross-sectional center of the channels 36, as seen in FIG. 6. For a washer developed in accordance with the invention to clean the cuvette rotor used in the Cobas-Bio centrifugal analyzer, it has been found that good performance is obtained when the longitudinal axes of the outlet channels 39 intersect a radial line drawn through the opening 40 at an angle of about 40 degrees. Other angles, of course, could be used, and may be required to obtain satisfactory operation with cuvette rotors that are configured differently from those used in the Cobas-Bio device.

As seen in FIG. 6, the outlet channels 39 and, hence, the jets 40 have their longitudinal axes oriented in a generally horizontal plane that lies generally parallel to the horizontal plane through the longitudinal axis of the reaction chamber 51 of the cuvettes 50. It will be appreciated that this orientation assures that the flow of fluid will have a horizontal force component directed toward the outermost end of the reaction chamber 51. As illustrated in FIG. 7, the jets 40 are positioned somewhat above the longitudinal centerline of the chambers 51 to enhance the development of a turbulent washing action.

As discussed earlier, a particular disadvantage of the known washers is the inability to thoroughly clean substances from the vertically oriented reaction and sample chambers of the cuvettes. In particular, such washers are unable to satisfactorily cleanse the reagents used in endpoint tests. To overcome these problems, the present invention provides a jet for directing cleansing fluid into the reaction and sample chambers of each cuvette. In the rotors used in the Cobas-Bio analyzer discussed herein, the reagent chamber 52 and sample chamber 53 are arranged side by side as shown in FIG. 8. In FIGS. 6 and 7, the "pocket" shape of the smaller sample chamber 53 is shown in broken line. In these Figures, the top edge of the common wall that separates the reagent and sample chambers is labeled 54. As illustrated in FIGS. 1 and 6 through 8, the rotor is placed in an inverted position upon the stator for cleansing. In operation within the centrifugal analyzer, the orientation is reversed so that reagents may be dispensed into the bottom of the deep well of the reagent chamber 52 and a mixture of the sample and a diluent may be dispensed into the small pocket of the sample chamber.

When operatively inverted over the stator, the rotor rests upon the shelf 11. In this position, the upper surface 21 of the shelf provides a bearing surface which is slidingly engaged by the vertical extensions 55 of the cuvettes. As seen best in FIGS. 6 and 7, the stator is configured and dimensioned so that the reagent and sample chamber 52 and 53, respectively, are supported above the annular ledge 37. As well, the stator is dimensioned so that the ring fits somewhat loosely thereabout. These relationships are provided to avoid frictional contact that would slow the speed of rotation of the ring and damage the cuvettes. A degree of spacing between the stator and the cuvettes is needed to permit drainage of the wash fluid. Provision of such spacing is particularly needed between the outer edge of the annular ledge 37 and the vertical extensions 55 of the cuvettes.

Referring again to FIG. 6, the sample and reagent chambers are cleansed by a jet 42 provided on the upper surface of the annular ledge 37 of the stator. This jet is oriented vertically to direct a flow of cleansing fluid upward into the sample and reagent chambers of each of the cuvettes. Since, in the preferred form of the washer, the rotor may spin at 200 rpm, during a typical five-minute wash cycle each of the cuvettes makes up to 1000 passes over jet 42. Thus, substantially all of the residual reagent and sample mixtures are thoroughly cleansed from the sample and reagent chambers. The jet 42 receives its supply of pressurized fluid through a channel 41 that is connected to a slot-like chamber 43 provided in the lower segment 31 of the stator (see FIGS. 4 and 5). When the two segments of the stator are operatively assembled, the slot-like supply chamber 43 for the vertical jet opens into the annular chamber 34 of the upper segment of the stator as shown most clearly in FIGS. 1 and 6. With reference to these Figures, it will be seen that the pressurized fluid flows through inlet pipe 19, into the annular chamber 34, and thence outward in both horizontal and vertical directions, i.e., through arcuate channels 36, outlet channels 39, and jets 40 and through chamber 43, channel 41, and jet 42. Since the two segments of the stator are assembled in fluid-tight engagement, it will be seen that there is a uniform distribution of pressure throughout the various chambers and conduits forming the jet and distribution system.

Referring now to FIG. 2, the pressure regulator 16 includes a pressure regulator 25, pressure gauge 26, and a valve 27, which is controlled by a timer 28 and solenoid 29. As noted above, the pressure regulator, timer, solenoid, and valve function to deliver a constant-pressure flow of washwater to the washer for a predetermined period of time. The selection of the operating pressure is determined by the configuration and dimensioning of the distribution and jet system of the stator. As discussed above, the jets that direct the wash fluid into the cuvette chambers are relatively small in relation to the channels that distribute the fluid to them. Consequently, significant velocities can be obtained for the flows exiting the jets. These velocities ensure not only good, turbulent cleaning action within the cuvettes, but also spin the rotor rapidly so that the individual cuvettes pass, and hence are washed by, the jets frequently during the wash cycle. For example, with a stator (developed for the Cobas-Bio device) having four equally spaced 1/16 inch diameter jets, which are fed by channels having $\frac{1}{8}$ inch$\times$3/16 inch rectangular cross sections, rotors have been driven in the range of about 170 to 200 rpm with a flow of water maintained at 15 pounds per square inch. It will be recognized that this preferred pressure falls significantly below the pressure level encountered with typical tap systems, and, as well, below the pressure level normally provided by laboratory deionized water systems. Importantly, the ability to employ such low pressure results in the usage of a minimal amount of water to obtain thorough cleaning. For example, at the preferred pressure, water usage is on the order of about 20 litres or less. This represents a significant reduction over the consumption of the known cuvette rotor washers. The cost savings to the user are particularly important where it is determined that use of an all-deionized water wash is mandatory.

To enhance cleaning of the cuvettes and to promote drainage of the spent cleaning fluid therefrom, it is preferred that the modified arrangement of FIGS. 9 and 10 be employed. In this arrangement, the individual cuvettes are lifted, or raised slightly, from the upper surface 21 of the shelf 11 during a portion, or all, of their rotational travel about the stator. This raising of the cuvettes provides both an enlarged area through which the fluid may drain and a means to overcome the surface tension of the fluid which otherwise tends to hold the spent fluid on the upper surface 21 of the shelf. While this raising of the cuvettes may be accomplished in a variety of ways, it has been found to be effectively, and economically, achieved by providing a single, outwardly extending riser element 60 on the upper surface 21 of the shelf 11 as shown in FIGS. 9 and 10. Riser element 60 is preferable a relatively short cylindrical peg, such as, for example, a segment taken from a cylindrical rod. As illustrated in FIG. 10, the vertical extension 55 of the individual cuvettes rests upon the upper surface of riser element 60. In the interconnected ring, the cuvettes are aligned so that the outermost surfaces of the respective vertical extensions 55, i.e., those surfaces which contact riser element 60, lie substantially planar to one another. Thus, riser element 60 functions to tilt the ring by lifting one side thereof. The opposite side of the ring continues to rest upon the upper surface of the shelf 11. To avoid the creation of undesirable friction between the rotor and the stator, it is preferably to use a relatively small angle of tilt, or amount of lift. Alternately, the stator could be configured to provide an axis of rotation that is likewise tilted in accordance with the tilt of the rotor.

During operation, with the rotor spinning, each cuvette is gradually elevated along an inclined path, reaching a highest point over riser element 60. Thereafter, the cuvettes are lowered along a similarly inclined path back towards the upper surface 21 of shelf 11. With this arrangement, the spent wash fluid drains freely from the cuvettes, cascading over the edge of shelf 11 and into the bottom of the container. With this enhanced drainage, more "fresh" wash fluid may be supplied to each cuvette during a wash cycle. This arrangement also promotes the development of a turbulent, bubbling flow which helps scrub the walls of the various chambers of the cuvettes. Although not critical, it has been observed that the drainage and cleaning action is most effective when the cuvettes are lifted in the area of the vertically oriented jet 42.

To avoid damaging the relatively fragile plastic cuvettes, it is preferred that riser element 60 be constructed of or coated with a suitable nonabrasive material. Glass has been found to be well suited for this purpose.

To further promote drainage of the spent fluid, one or a plurality of drainage channels 61 may be provided through the shelf 11. To promote a flow of fluid therethrough, it is preferred that the drainage channel 61 be oriented at an angle relative to the direction of rotation of the rotor as shown in FIG. 9, where the rotor direction is indicated by the arrow 62. Drainage may also be improved by removal of a portion or portions of ledge 37 except for a small area around the vertical jet 42.

As an alternative to the single riser element just discussed, drainage of fluid from shelf 11 may be enhanced by continuously raising the cuvettes relative to the upper surface 21 of the shelf. Although not illustrated, it will be easily seen that this may be accomplished by providing a plurality of riser elements at spaced intervals about the upper surface 21 of shelf 11. For example, four of such riser elements having substantially equal heights and disposed at right angles relative to one another, would maintain a permanent spaced relation between the cuvette rotor and the upper surface 21 of the shelf. It is to be recognized, of course, that, with plural riser elements the rotor could also be lifted unevenly to provide a measure of tilt similar to the tilt obtained with the single riser element. However, for the same reasons discussed above, the ring may not be lifted in a manner that would unnecessarily create friction and thus interfere with the desired objective of good rotation of the ring.

It is to be noted again that the preferred form of the invention described herein is advantageously adapted for use with the disposable cuvette rotors of the Cobas-Bio centrifugal analyzer. For such rotors, the employment of four jets 40 to clean the horizontal reaction chambers 51 and to spin the rotor, and the use of a single jet to clean the vertical reagent and sample chambers, 52 and 53, respectively, provides thorough cleaning so as to render the otherwise disposable rotors reusable. It is within the inventive concepts herein to employ fewer or more than four jets 40 and more than a single jet 42.

As long as a good rotational axle is provided for the rotor, it is also not essential that the upper disc portion 35 of the lower segment have the same diameter as the upper segment 30. For example, the disc portion 35 may have a diameter that is less than the diameter of the upper segment 30. It is also not essential that the axle function of the stator be provided by a continuous cylindrical surface. For example, rather than the preferred disc-like axle, the axle could have a spoke-like arrangement of segments, the outer surfaces of the segments defining the circular path about which the rotor spins.

It is to be appreciated that with disposable rotors of different analyzers, the arrangement of the various reaction, reagent, and sample chambers may well require reconfiguration of the stator to conform to the inside diameter and other pertinent inner dimensions of the cuvette rotor and to reorient the jets in order to direct flows of cleaning fluid into each of the various chambers. The invention should be understood as contemplating that it may be necessary to orient the jets in more than one direction in order to thoroughly cleanse each of the chambers of the cuvettes.

The present invention has been described in relation to its preferred embodiments. One of ordinary skill, after reading the foregoing specification, will be able to effect various changes and substitutions of equivalents without departing from the broad concepts disclosed herein. It is therefore intended that the protection afforded by Letters Patent granted hereon be limited only by the definition contained in the appended claims and equivalents thereof.

The embodiments of the invention in which an exclusive property or privilege is claimed are defined as follows:

1. A washer for cleaning a disposable cuvette rotor, said rotor having a plurality of cuvettes interconnected to form a ring, said washer comprising:

a stator upon which the ring is positioned for rotation, said stator having an upper disc connected to a base;

said upper disc extending outward from a support surface of said base and including a plurality of jets, said jets being disposed about the side periphery of said disc, each of said jets being arranged to direct a flow of fluid into said cuvette in a predetermined direction so as to rotate said ring and clean said cuvettes;

said base including a jet, said jet being arranged to direct a flow of fluid into said cuvettes in a direction that is oriented at an angle relative to the directions of the flows from the jets of said upper disc so as to clean said cuvettes, said base including a race that is adapted for sliding engagement with said ring, said race including a riser element disposed upon said support surface at a selected position about said disc, said riser element lifting each of said cuvettes from said support surface when said ring is rotated; and supply means for delivering fluid to said jets.

2. A washer for cleaning a disposable cuvette rotor, said rotor having a plurality of cuvettes interconnected to form a ring, said washer comprising:

a stator upon which the ring is positioned for rotation, said stator having an upper disc connected to a base;

said upper disc extending outward from a support surface of said base and including a plurality of jets, said jets being disposed about the side periphery of said disc, each of said jets being arranged to direct a flow of fluid into said cuvettes in a predetermined direction so as to rotate said ring and clean said cuvettes;

said base including a jet, said jet being arranged in direct a flow of fluid into said cuvettes in a direction that is oriented at an angle relative to the directions of the flows from the jets of said upper disc so as to clean said cuvettes, said base including a race that is adapted for sliding engagement with said ring, said race including a plurality of riser elements disposed about said support surface at selected positions about said disc, said riser elements supporting said cuvette rotor in continuous, spaced-apart relation to said support surface to enhance cleaning of said cuvettes and promote drainage of fluid therefrom; and supply means for delivering fluid to said jets.

3. A washer for cleaning a plurality of cuvettes, each of said cuvettes having horizontal and vertical cavities, said cuvettes being interconnected to form a ring wherein said horizontal cavities are oriented radially and said vertical cavities are oriented axially, said washer comprising:

a generally cylindrical stator upon which said ring is positioned for rotation, said stator having a plurality of jets disposed about the circular periphery thereof, each of said jets being oriented to direct a flow of fluid at a predetermined angle into the horizontal cavities of said cuvettes so as to rotate said ring and clean said horizontal cavities;

an annular ledge encircling the lower periphery of said stator, said ledge including a jet, said jet being oriented to direct a flow of fluid at a predetermined angle into the vertical cavities of said cuvettes so as to clean said vertical cavities; and supply means for delivering fluid to said jets.

4. The washer of claim 3, wherein:

each of the jets of said stator is oriented to direct a flow of fluid in a nonradial direction into the horizontal cavities of said cuvettes; and the jet of said annular ledge is oriented to direct a flow of fluid in an axial direction into the vertical cavities of said cuvettes.

5. The washer of claim 4, wherein said supply means comprises:

conduit means disposed within the interiors of said stator and said annular ledge for delivering a flow of fluid to each of said jets; and regulator means for delivering a flow of fluid to said conduit means.

6. The washer of claim 5, wherein said regulator means includes means for controlling the pressure and duration of said flow.

7. The washer of claim 4, further including:

a supporting base having a support surface, said stator and annular ledge being connected to said base and extending outward from said support surface; and lift means for selectively raising each of said cuvettes relative to said support surface when said ring is rotated.

8. The washer of claim 7, wherein said lift means comprises a riser element, said riser element being disposed upon and extending outward from said support surface, said riser element being adapted to selectively engage said cuvettes.

9. The washer of claim 8, wherein said supporting base further includes drainage means for draining fluid from said support surface.

10. The washer of claim 7, wherein said lift means supports said cuvette rotor in continuous, spaced-apart relation to said support surface.

11. The washer of claim 10, wherein said lift means comprises a plurality of riser elements, said riser elements being disposed upon and extending outward from said support surface, said riser elements being adapted to selectively engage said cuvettes.

12. The washer of claim 11, wherein said supporting base further includes drainage means for draining fluid from said support surface.

* * * * *